United States Patent [19]

Kojima

[11] Patent Number: 4,917,638

[45] Date of Patent: Apr. 17, 1990

[54] ENGINE COVERED BY A COWLING FOR A MARINE PROPULSION DEVICE

[75] Inventor: Akinori Kojima, Shizuoka, Japan

[73] Assignee: Sanshin Kogyo Kabushiki Kaisha, Hamamatsu, Japan

[21] Appl. No.: 630,979

[22] Filed: Jul. 16, 1984

[30] Foreign Application Priority Data

| | | | |
|---|---|---|---|
| Jul. 27, 1983 | [JP] | Japan | 58-135732 |
| Jul. 27, 1983 | [JP] | Japan | 58-135733 |
| Jul. 27, 1983 | [JP] | Japan | 58-135734 |

[51] Int. Cl.[4] ..... F02B 33/04

[52] U.S. Cl. ..... 440/77; 440/76

[58] Field of Search ..... 440/76, 77; 123/195 P, 123/196 R, 196 W

[56] References Cited

U.S. PATENT DOCUMENTS

| | | | |
|---|---|---|---|
| 2,460,419 | 2/1949 | Kincannon | 123/195 P |
| 2,569,346 | 9/1951 | Shively | 123/195 P |
| 4,134,380 | 1/1979 | Niwa | 123/196 R |
| 4,372,258 | 2/1983 | Iwai | 123/196 W |
| 4,457,274 | 7/1984 | Gottlob | 123/196 R |
| 4,493,661 | 1/1985 | Iwai | 440/77 |

*Primary Examiner*—Joseph F. Peters, Jr.
*Assistant Examiner*—Clifford T. Bartz
*Attorney, Agent, or Firm*—Ernest A. Beutler

[57] ABSTRACT

An outboard motor and more particularly an improved power head layout for an outboard motor wherein an engine, starter motor, lubricant storage tank, spark advance linkage, throttle control linkage, and firing system for the spark plugs are all contained within the protective cowling of the power head and disposed so that they may be conventiently serviced while at the same time providing a compact arrangement.

22 Claims, 5 Drawing Sheets

ENGINE COVERED BY A COWLING FOR A MARINE PROPULSION DEVICE

BACKGROUND OF THE INVENTION

This invention relates to an engine covered by a cowling for a marine propulsion device and more particularly to an improved, compact power head arrangement for an outboard motor.

The desire to provide a compact arrangement for outboard motors is obvious. However, recently the increased number of accessories and components used with outboard motor engines and the increasing size of the engine itself has made it difficult to provide a compact cowling arrangement for outboard motors. The addition of such components as electrical starters, the use of sophisticated electronic ignition systems and the desirability of providing a separate lubricating system embodying a separate lubricating tank contained within the protective cowling have greatly complicated the problems in providing a compact arrangement.

It is, therefore, a principal object of this invention to provide an improved and compact power head construction for an outboard motor.

It is another object of this invention to provide a placement of the components of an outboard motor which will provide adequate space for servicing of all of the components and yet which will nevertheless employ a compact arrangement.

SUMMARY OF THE INVENTION

A first feature of this invention is adapted to be embodied in an outboard motor comprising an internal combustion engine disposed with its output shaft rotational axis disposed in a generally vertical direction. A protective cowling encircles the engine and a liquid tank is contained within the protective cowling and disposed on one side of the engine. An electric starter motor is contained within the protective cowling and is disposed on the opposite side of the engine from the liquid tank.

Another feature of the invention is also adapted to be embodied in an outboard motor construction having an internal combustion engine and a liquid tank disposed within a protective cowling. In accordance with this feature of the invention, the liquid tank is provided with a substantially lesser cross-sectional area in transverse planes at its lower periphery than at its upper periphery so that a substantial portion of the capacity of the tank is positioned at a high level.

Yet another feature of the invention is adapted to be embodied in an outboard motor having an internal combustion engine of the spark ignition type that is contained within a protective cowling and which includes a cylinder head in which the spark plugs of the engine are mounted. In accordance with this feature of the invention, an ignition system is provided for firing the spark plugs and in which the major components are disposed on one side of the cylinder head.

Yet another feature of this invention is adapted to be embodied in an electrically started outboard motor having an internal combustion engine disposed with the rotational axis of its output shaft extending in a substantially vertical direction and carrying a flywheel with a starter gear at its upper end. In accordance with this feature of the invention, a starter motor is provided which cooperates with the starter gear for electrically starting the motor and which starter motor has a rotational axis of its output shaft that is parallel to the axis of rotation of the engine output shaft. The rotational axis of the starter gear is, however, offset from the plane of the engine components which are joined to provide the rotational support for the engine output shaft.

DETAILED DESCRIPTION OF THE PREFERRED EMBODIMENT

Figure 1:
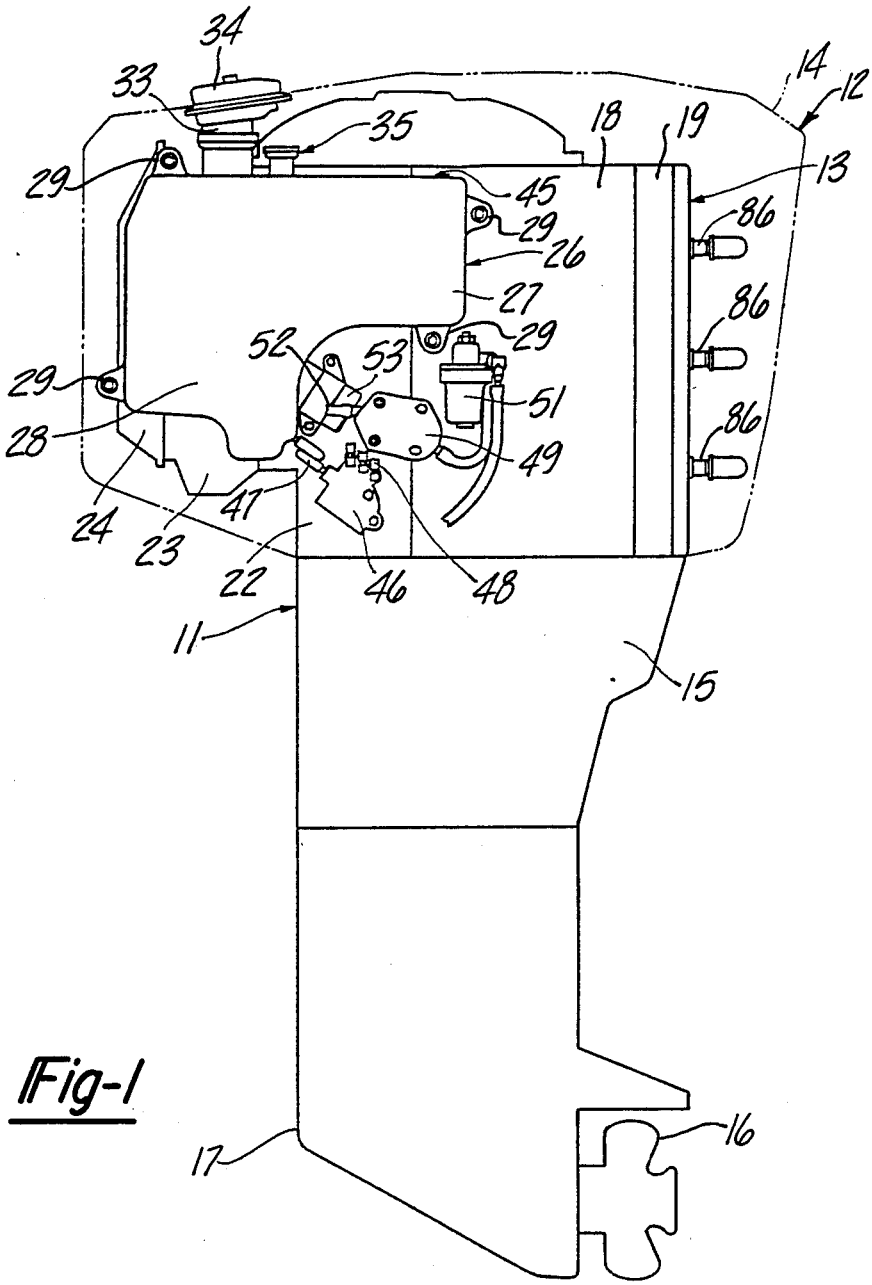
FIG. 1 is a side elevational view of an outboard motor constructed in accordance with an embodiment of the invention with the protective cowling of the power head shown in phantom.
Figure 2:
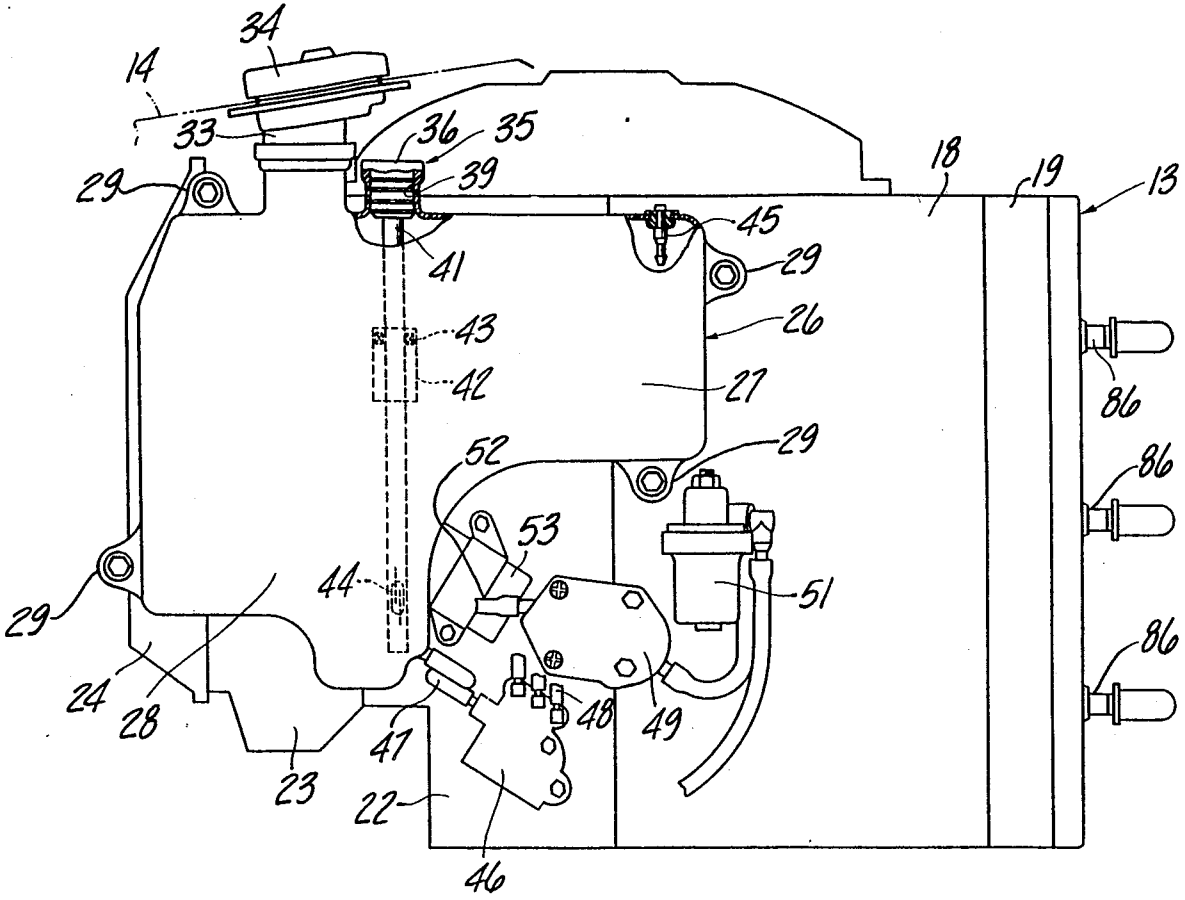
FIG. 2 is an enlarged side elevational view, looking in the same direction as FIG. 1, of the power head with the cowling removed.

Referring first to FIG. 1, an outboard motor constructed in accordance with an embodiment of this invention is identified generally by the reference numeral 11. The outboard motor 11 includes a power head, indicated generally by the reference numeral 12 and which contains an internal combustion engine 13. The engine 13 is of the three cylinder in-line type and is operated on the two-stroke principle. The engine 13 is disposed so that its crankshaft is rotatable about a vertically extending axis. The engine 13 and certain auxiliary components associated with it are contained within a protective cowling 14, which has been shown at least partially in phantom in certain of the figures. The output shaft of the engine 13 drives a drive shaft (not shown) which extends vertically through a drive shaft housing 15 for driving a propeller 16 of a lowe runit 17 through a suitable forward, neutral, reverse transmission (not shown).

The engine 13 is comprised of a cylinder block 18 in which three vertically aligned cylinder bores (not shown) are formed. A cylinder head 19 is affixed to the cylinder block 18 in a suitable manner an defines the respective combustion chambers with the pistons of the engine. Inasmuch as the internal components of the engine 13 form no part of the invention, except for the orientation of the engine and its accessory components, these internal components have not been illustrated nor will they be described in detail.

As has been noted, the engine has its crankshaft supported for rotation about a vertically extending axis. Only the upper end of the crankshaft is shown in the drawings and it is identified generally by the reference numeral 21. The crankshaft 21 is upported for rotation by suitable bearings that are interposed between the cylinder block 18 and a crankshaft 22 that is affixed to the cylinder block 18 in a known manner. The rotational axis of the crankshaft 21 lies ont he parting line between the lower end of the cylinder block casting 18 and the adjacent end of the crankcase casting 22.

As has been noted, the engine 13 operates on the two-stroke cycle and, therefore, the crankcase chambers defined by the cylinder block 18 and crankcase 22 associated with each of the cylinders are sealed from each other. An intake system is provided for delivering a fuel/air mixture to each of these chambers and this intake system includes vertically disposed carburetors 23, one for each cylinder, which feed their charge to the crankcase chambers through an appropriate manifold and reed type check valves as is well known in this art. An air intake device 24 registers with the air horns of the carburetors 23 and has a rearwardly directing inlet opening 25 that communicates with the hollow interior of the protective cowling 14 so that air may be drawn into the carburetors 23. A suitable air inlet opening is provided in the outer cowling 14 so as to admit induction air into the hollow interior.

Unlike conventional two-cycle outboard motor engines, the engine 13 is supplied with a separate lubricating system so that it will not be necessary for the operator to mix lubricating oil with the fuel. This separate lubricating system includes a lubricant storage tank, indicated generally by the reference numeral 26 which has a generally L shaped configuration when viewed in side elevation. This configuration consists of an upper portion 27 and a lower portion 28. The upper portion 27 has a substantially greater cross-sectional area in horizontal planes than does the lower section 28 so that a larger proportion of the volume of lubricant in the tank 26 will be contained in the upper, higher portion 27. In addition to providing a relatively large lubricant capacity, this configuration insures a good head of lubricant even though only a small amount of lubricant may remain in the tank 26. Also, this configuration of the tank 26 permits the other components of the engine to be contained neatly within the protective cowling 14 and yet readily accessible upon removal of the protective cowling 14.

Figure 4:
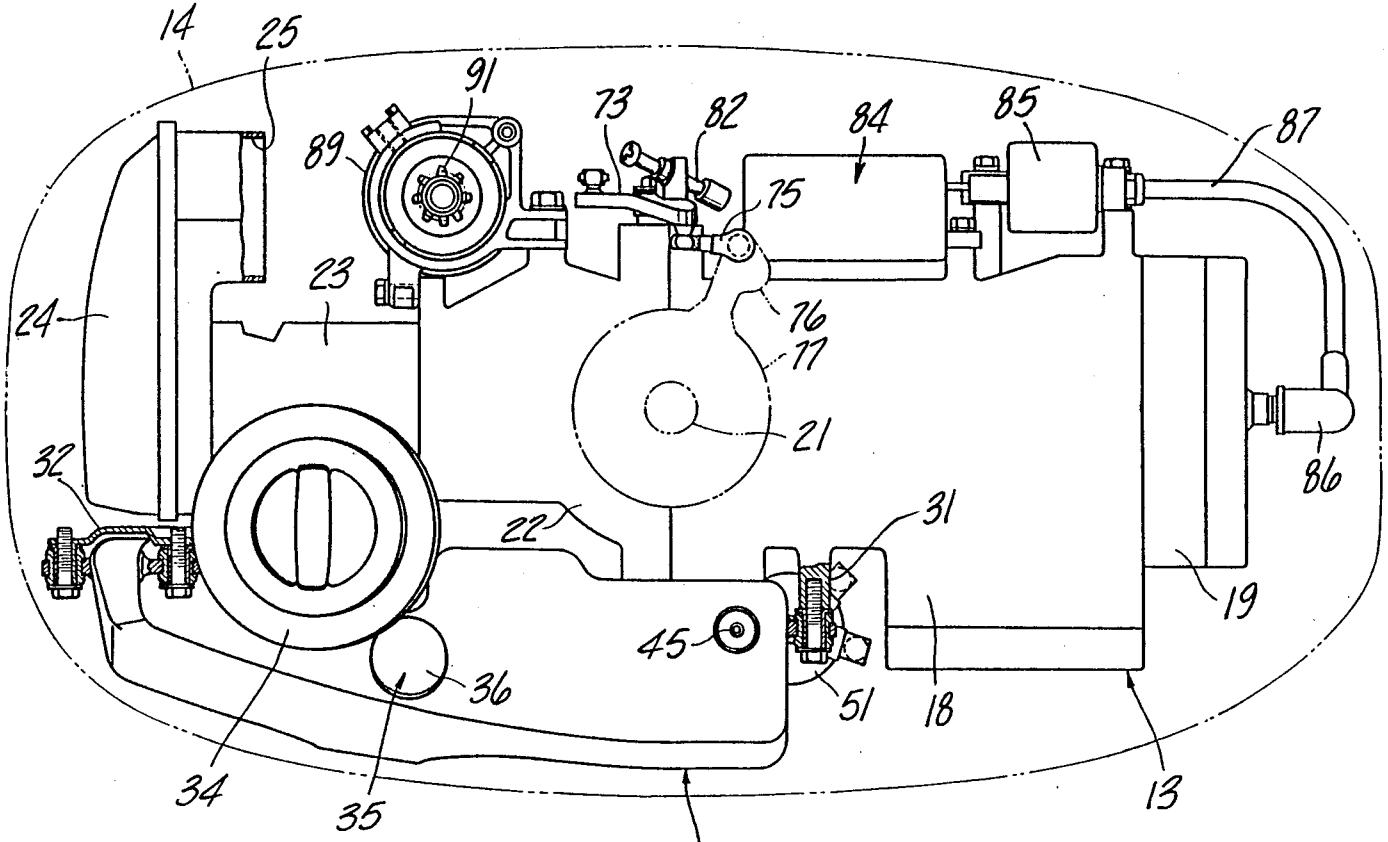
FIG. 4 is a top plan view of the power head.

The tank 26 is mounted on one side of the engine and in proximity to the induction system and the crankcase with the smaller lower portion 28 being positioned in proximity to the lowermost of the carburetors 23 while the larger upper portion 27 extends across the uppermost carburetors 23 and across a portion of the upper part of the crankcase 17 and a very small portion of the upper part of the cylinder block 18. For mounting purposes, the tank 26 is provided with a plurality of mounting lugs 29 through which appropriate fasteners pass so as to secure the tank 26 relative to the engine 13. Some of these fasteners are threaded into lugs 31 formed in the cylinder block 18 (FIG. 4) while others are threaded into a mounting bracket 32 that is appropriately fixed relative to the engine 13.

The tank 26 is provided with a filler neck 33 that extends upwardly through the cowling 14 and which receives a closure cap 34 that is externally accessible so that the amount of lubricant in the tank 26 can be conveniently replenished without necessitating removal of the cowling 14.

A sensing device, indicated generally by the reference numeral 35 is provided so as to give the operator a warning of a low lubricant condition. The sensing device 35 consists of a plug 36 that is mounted in an aperture 39 formed in the upper wall of the tank 26 and from which a pipe or rod 41 depends into the interior of the tank 26 and which terminates adjacent the lowermost portion of the tank part 28. A float 42 is slidably supported on the rod 41 and carries a magnet or the like 43 that is adapted to actuate a switch 44 positioned at the lower end of the rod 41 so as to provide a warning signal or indication to the operator when the level of lubricant in the tank 26 falls to a point where replenishment is required. A vent valve 45 is also provided in the upper wall of the tank 26 so as to permit air to enter the tank to compensate for the volume of lubricant which is consumed.

A lubricant pump 46 is mounted below the tank 26 on the same side of the crankcase 22 and is driven from the engine 13 in any appropriate manner. The lubricant pump 46 receives lubricant from the tank 26 through a lubricant delivery conduit 47 that extends from contiguous to the lowermost portion of the tank portion 28. As has been previously noted, the substantial volume of lubricant in the tank is contained in the higher placed portion 27 so as to insure a good head of lubricant to the pump 46 even when only small amounts of lubricants remain in the tank 26.

The lubricant is delivered from the pump 46 to appropriate components of the engine from distributor tubes 48 that extend from the pump 46. These distributor tubes 48 may terminate at pressure lubricated points in the engine 13, may terminate at the intake manifold for spraying lubricant into the induction system or may extend to any appropriate portions of the engine for its lubrication. Since the internal portion of the lubrication system for the engine 13 forms no part of the invention, this portion has not been described in any great detail.

Also contained within the cavity of the L shape of the lubricant tank 26 is a fuel pump 49 that receives fuel from a remote fuel source by a suitable conduit and in which a fuel filter 51 is provided. The fuel pump 49 is also driven by the engine 13. The fuel pump 49 delivers fuel through a conduit 52 and appropriate manifolding to the carburetors 23 in a known manner.

Figure 3:
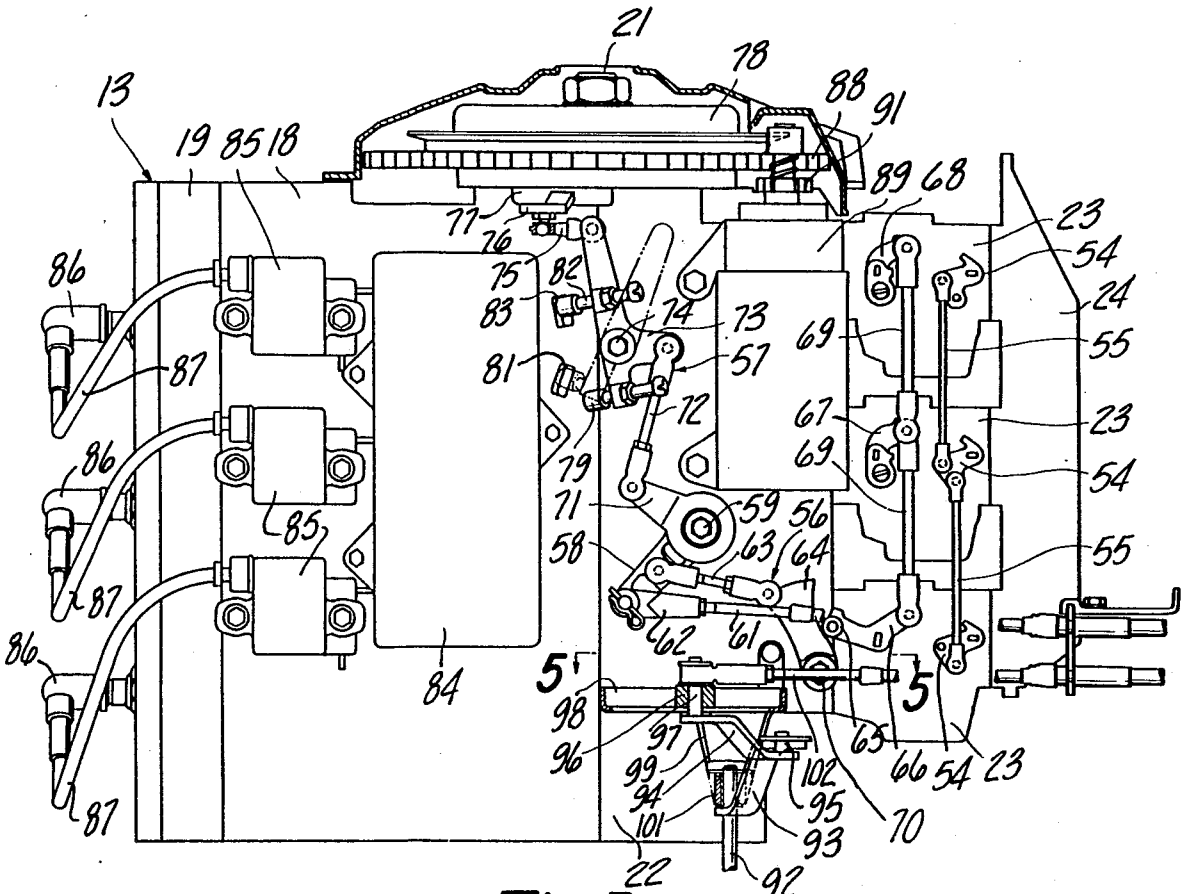
FIG. 3 is a side elevational view of the power head looking from the side opposite to that of FIG. 2.

Further contained within the cavity defined by the L shape of the lubricant tank 26 is an electric solenoid 53 that is connected in an appropriate manner to a lever (not shown) fixed to the choke valve shaft of one of the carburetors 23. The choke valve shafts are all linked together by means of levers 54 and interconnecting links 55 on the opposite side of the engine 13 (FIG. 3). Actuation of the solenoid 53 under low temperature conditions will cause the choke valves to be closed so as to provide cold starting and cold running enrichment in a known manner.

It should be readily apparent that the described construction of the components on this side of the engine, consisting of the lubricant tank 26, fuel pump 49 and lubricant pump 46 provides a relatively compact assembly which can be conveniently contained within the protective cowling 14 without requiring a large cowling and yet which offers easy access to all of these components once the cowling 14 is removed for servicing. A similar compact yet accessible layout is employed on the opposite side of the engine 13 as will now be described.

Referring now primarily to FIG. 3, the linkage 56 and levers 54 for connecting the choke valves of the carburetors 23 to each other is shown. Also the throttle control and spark advance control mechanism is located on this opposite side. The throttle control linkage is identified generally by the reference numeral 56 and the spark advance linkage is indicated generally by the reference numeral 57.

The throttle control linkage 56 includes a main control lever 58 that is pivotally mounted on this side of the engine and specifically upon the crankcase 22 by means of a supporting pivot bolt 59. One end of a flexible transmitter 61 is connected to the outer end of the lever 58 by means of a clevis 62. The other end of the wire actuator 61 is positioned either on the outer cowling 14 or may be remotely operated, as desired. A throttle control ink 63 is pivotally connected at one end to the lever 58 inwardly of the clevis 62. The opposite end of the link 63 is connected to a cam member 64 which cooperates with a follower 65 carried by a lever 66 that is affixed to the throttle valve shaft of the lowermost carburetor 23. The cam member 64 is journaled on the crankcase 22 by a pivot bolt 70. Hence, rotation of the cam 64 will cause the follower 65 to be moved and position this throttle valve. The lever 66 is also connected to corresponding levers 67 and 68 of the center and uppermost carburetors by a pair of links 69 so that all of the throttle valves will be operated in unison.

The spark advance mechanism 57 includes a spark advance lever 71 that is also journaled on the cylinder block 22 by the pivot bolt 59. The spark advance lever 71 is operatively connected to the throttle operating lever 58 by means of a spring biased lost motion connection so that upon initial rotation of the throttle control lever 58, the spark advance lever 71 will rotate with it. After a predetermined degree of rotation, which is controlled in a manner to be described, the rotation of the spark advance lever 71 will be halted and the throttle control lever 58 may continue its rotation to full throttle opening position.

A link 72 is pivotally connected at one of its ends to the spark advance lever 71 and at its opposite ends to one arm of a bellcrank 73. The bellcrank 73 is also rotatably supported on the crankcase 22 by means of a pivot bolt 74. Another arm of the bellcrank 73 is connected by means of a short connecting link 75 to a spark control lever 76. The spark control lever 76 is formed on a spark control plate 77 that supports the triggering assembly of the ignition system, which triggering assembly may be of any known type. This triggering assembly cooperates with a permanent magnet or magnets which are rotatably carried by a flywheel 78 that is affixed to the upper end of the crankshaft 21. Rotation of the plate 77 will effect a change in spark timing, as is well known.

A first adjustable stop 79 is carried by the bellcrank 73 and is adapted to engage a fixed stop member 81 fixed to the cylinder block 18 so as to set the minimum spark advance of the timing plate 77. A further adjustable stop 82 is carried by the other arm of the bellcrank 73 and is adapted to engage a fixed stop 83 carried by the cylinder block 18 adjacent the stop 81. Engagement of the adjustable stop 82 with the fixed stop 83 will determine the maximum spark advance characteristic. Once the adjustable stop 82 engages the fixed stop 83, further rotation of the bellcrank 73, spark plate 77 and spark advance lever 71 will be halted.

The signal from the triggering device carried by the spark plate 77 is transmitted through a suitable transmitter to a spark control box, indicated generally by the reference numeral 84 and in which the circuit for firing the individual spark plugs is contained. The spark control box 84 is disposed on this side of the cylinder block 18 and adjacent the throttle linkage 56 and spark advance linkage 57. The output signals from the spark control box 84 are transmitted to individual spark coils 85 which are also mounted on this side of the engine and which deliver a high voltage firing charge to individual spark plugs 86 via high tension conductors 87.

It should be readily apparent that the placement of the spark firing system is very close to the spark plugs and thus eliminates the need for long conductors. In addition, because of the placement, the elements of the spark control system are all readily accessible and may be easily serviced by removing of the protective cowling 14. In a like manner, the throttle control linkage 56 and spark control linkage 57 are also equally accessible for servicing and adjustment.

The engine 13 is provided with an electric starter and for this purpose a starter ring gear 88 is affixed to the outer periphery of the flywheel 78. It is the normal practice to position the starter motor in line with the crankshaft rotational axis 21 and on the plane between the mating faces of the cylinder block 18 and crankcase 22. Such a placement, however, adds considerably to the width of the overall assembly and specifically the width of protective cowling necessary to enclose the starter. In accordance with a feature of the invention, an electric starter motor 89 is carried by the crankcase 22 closely adjacent the carburetors 23 and offset from the mating plane between the crankcase 22 and cylinder block 18. In this way, the width of the overall assembly is substantially reduced and, furthermore, the spark control linkage 57 and throttle control linkage 56 are not obscured and is readily accessible in the area between the starter motor 89 and the spark control box 84.

A pinion gear 91 is driven by the starter motor 89 through a suitable Bendix drive for engagement with the ring gear 88 to start the motor 13 in a known manner.

As has been noted, the lower unit 17 includes a forward, neutral, reverse transmission for coupling the engine driving shaft to the propeller 16. This transmission has a suitable shifting mechanism that is operated under the control of a vertically extending control rod 92 that is supported for rotation in a suitable manner within the drive shaft housing 15 and lower unit 17 and which terminates at its upper end adjacent this side of the engine 13 in proximity to the crankcase 22 and beneath the starter motor 89.

A lever 93 is affixed to the upper end of the control rod 92. A link 94 is pivotally connected at one of its ends to the outer end of the lever 93 by means of a pivot pin 95. The opposite end of the link 94 carries a roller follower 96 on a pivot shaft 97. The roller followr 96 is received within an arcuate cam groove 98 formed by a bracket 99 that is affixed to this side of the crankcase 22. The bracket 99 also rotatably journals the upper end of the control rod 92 by means of an anti-friction bushing 101 carried at its lower end.

Figure 5:
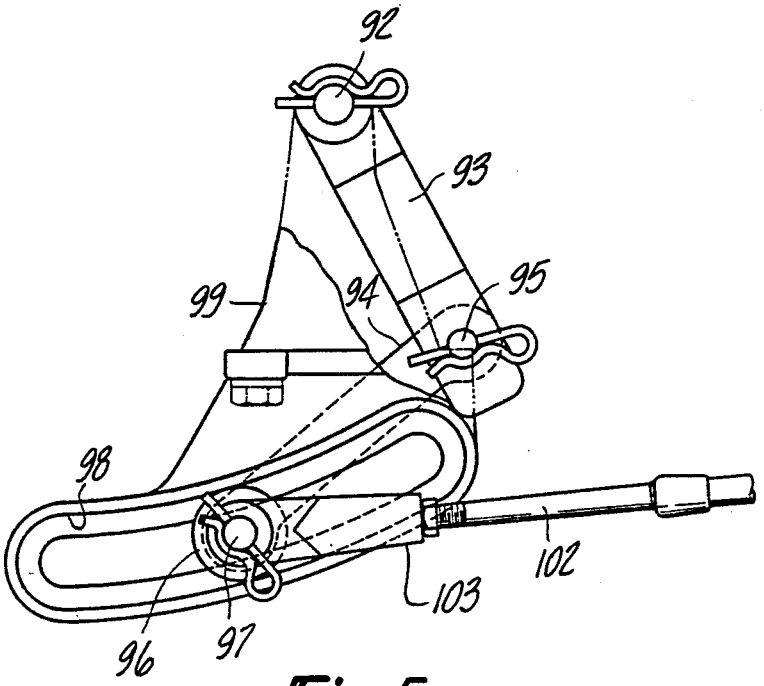
FIG. 5 is an enlarged view taken along the line 5—5 of FIG. 3 and showing the controlling apparatus for the transmission of the motor.

A transmission control bowden wire actuator 102 is connected to the upper end of the pin 97 by means of a clevis 103. Therefore, pulling movement of the wire actuator 101 will cause the pin 97 and roller follower 96 to traverse the arcuate cam groove 97 so as to rotate the lever 93 and operating rod 92 to effect shifting of the transmission. FIG. 5 shows the mechanism in the neutral position. Movement to one end of the cam groove 98 will effect shifting into forward and movement to the other end of the cam groove will effect shifting into reverse.

It should be readily apparent that the layout of the engine 103 and its various components such as the lubricant storage tank 26, starter motor 89, spark control box 84, and throttle control linkage 56 and spark control linkage 57 is such that an extremely compact arrangement is provided while at the same time all of the components are readily accessible for servicing upon removal of the protective cowling 14. Although an embodiment of the invention has been illustrated and described, it should be readily apparent that various changes and modifications may be made, without departing from the spirit and scope of the invention, as defined by the appended claims.

I claim:

1. An outboard motor comprising an internal combustion engine having a lubricating system and disposed with the rotational axis of its output shaft extending substantially in a vertical direction, a protective cowling enclosing said engine, a liquid tank containing lubricant for the engine lubricating system contained within said protective cowling and disposed below the top of and on one side of said engine, and an electric starter motor contained within said protective cowling and disposed on the opposite side of said engine from said liquid tank.

2. An outboard motor as set forth in claim 1 wherein the liquid tank has a substantially greater cross-sectional area on a transverse plane taken at its upper end than at its lower end.

3. An outboard motor as set forth in claim 2 wherein the liquid tank is generally L shaped in plan view with its long leg extending horizontally.

4. An outboard motor as set forth in claim 3 further including an engine driven accessory mounted within the recess defined by the L shape of the liquid tank.

5. An outboard motor as set forth in claim 4 wherein the engine driven accessory comprises a pump driven by the engine and further comprising a lubricant pump adjacent said pump and also driven by said engine,said lubricant pump receiving lubricant for the tank for delivery to the engine lubricating system for its lubrication.

6. An outboard motor as set forth in claim 1 further including an ignition system comprising a circuit contained within a spark control box, said spark control box being mounted on a side of the engine and in proximity to the spark plugs.

7. An outboard motor as set forth in claim 6 wherein the spark control box is mounted on the same side of the engine as the electric starter motor.

8. An outboard motor as set forth in claim 7 wherein the starter motor is offset from a plane containing the rotation axis of the output shaft and defined by mating components of the engine.

9. An outboard motor as set forth in claim 8 wherein the engine is of the two-cycle type and the mating components comprise the cylinder block and crankcase.

10. An outboard motor as set forth in claim 9 further including throttle linkage for controlling the throttle valves of the engine and disposed between the spark control box and the starter motor.

11. An outboard motor as set forth in claim 1 wherein the engine comprises a reciprocating multi-cylinder engine with the cylinders being vertically aligned with each other.

12. An outboard motor as set forth in claim 11 wherein the liquid tank has a substantially greater cross-sectional area on a transverse plane taken at its upper end than at its lower end.

13. An outboard motor as set forth in claim 12 wherein the liquid tank is generally L shaped in plan view with its long leg extending horizontally.

14. An outboard motor as set forth in claim 13 further including an engine driven accessory mounted within the recess defined by the L shape of the liquid tank.

15. An outboard motor as set forth in claim 14 wherein the tank comprises a lubricant storage tank and the engine driven accessory comprises a lubricant pump driven by the engine and receiving lubricant from the tank for delivery to the engine for its lubrication.

16. An outboard motor as set forth in claim 11 further including an ignition system comprising a circuit contained within a spark control box, said spark control box being mounted on a side of the engine and in proximity to the spark plugs.

17. An outboard motor as set forth in claim 16 wherein the spark cntrol box is mounted ont he same side of the engine as the electric starter motor.

18. An outboard motor as set forth in claim 17 wherein the starter motor is offset from a plane containing the rotation axis of the output shaft and defined by mating components of the engine.

19. An outboard motor as set forth in claim 18 wherein the engine is of the two-cycle type and the mating components comprise the cylinder block and crankcase.

20. An outboard motor as set forth in claim 19 further including throttle linkage for controlling the throttle valves of the engine and disposed between the spark control box and the starter motor.

21. An outboard motor construction comprising a power head consisting of an internal combusion engine and a surrounding protective cowling, a liquid tank contained within said protective cowling and supported by said engine, said liquid tank having a substantially greater cross-sectional area in transverse horizontal planes at its uper end than at its lower end so that a substantial portion of the internal volume of the liquid tank is defined by the upper portion thereof, said liquid tank comprising a lubricant tank for containing lubricant for the engine and having an L shape in side elevational view with the long leg of the L extending horizontally, said outboard motor further including an engine driven lubricant pump having its inlet in communication with said lubricant tank and being disposed contiguous to the recess of the L and adjacent the termination of the short leg.

22. An outboard motor comprising a power head having an internal combustion engine and a surrounding protective cowling, said internal combustion engine including a cylinder head mounting spark plug means, and a control circuit for firing said spark plug means and disposed on one side of said engine in proximity to said spark plug means, wherein said spark plug means comprises a plurality of spark plugs, and further wherein the means for firing the spark plug means consists of a plurality of firing coils, one for each of said spark plugs disposed in proximity to said spark plugs, and a control box containing a control circuit for firing said spark plugs, all positioned adjacent to said spark plugs, wherein the said engine has a crankshaft supported for rotation about a vertically extending axis by means of a cylinder block and crankcase having mating faces defining a plane containing the axis of rotation of said crankshaft, a ring gear affixed to said crankshaft, and a starter motor having a pinion gear adapted to engage said ring gear and offset from the plane of the mating faces of said cylinder block and said crankcase, said starter motor being positioned on the same side of said engine as the control box.

* * * * *